US005737784A

United States Patent [19]

Jackman

[11] Patent Number: 5,737,784

[45] Date of Patent: Apr. 14, 1998

[54] PROTECTIVE BED FRAME WITH EARTHQUAKE SHELTER

[76] Inventor: Douglas S. Jackman, P.O. Box 3581, Orange, Calif. 92587

[21] Appl. No.: 792,379

[22] Filed: Feb. 3, 1997

Related U.S. Application Data

[60] Provisional application No. 60/024,562, Aug. 26, 1996.

[51] Int. Cl.[6] ..... A47C 29/00; A47C 19/22

[52] U.S. Cl. ..... 5/414; 5/310; 5/286; 5/301; 5/907; 52/167.4

[58] Field of Search ..... 5/400, 280, 286, 5/293, 298, 301, 305, 310, 414, 907, 10.1; 52/167.1, 167.4

[56] References Cited

U.S. PATENT DOCUMENTS

| | | | |
|---|---|---|---|
| 789,869 | 5/1905 | Nelson | 5/293 |
| 1,190,222 | 7/1916 | Davis | 5/10.1 |
| 2,607,047 | 8/1952 | Posey . | |
| 4,069,527 | 1/1978 | Harris | 5/293 |
| 4,490,864 | 1/1985 | Wicker . | |
| 4,779,294 | 10/1988 | Miller . | |
| 4,782,541 | 11/1988 | Tuchman . | |
| 4,965,895 | 10/1990 | Shustov . | |
| 5,111,543 | 5/1992 | Epshetsky . | |
| 5,241,717 | 9/1993 | Ward . | |
| 5,615,424 | 4/1997 | Nakata | 5/414 X |

FOREIGN PATENT DOCUMENTS

| | | | |
|---|---|---|---|
| 278296 | 9/1914 | Germany | 5/286 |

*Primary Examiner*—Michael F. Trettel
*Attorney, Agent, or Firm*—James G. O'Neill

[57] ABSTRACT

A bed frame to protect a person during a calamity is constructed from generally horizontal upper and lower subassemblies secured to two generally vertical end supporting subassemblies. The subassemblies are secured together by internal securing devices to resemble a conventional bed, and the entire assembly is secured to a supporting surface by further securing devices held internally of the two generally vertical end supporting assemblies.

9 Claims, 3 Drawing Sheets

PROTECTIVE BED FRAME WITH EARTHQUAKE SHELTER

CROSS REFERENCE TO RELATED APPLICATIONS

The invention disclosed herein was the subject of disclosure document No. 403940, filed August 1996, and this application is a replacement application for provisional application Ser. No. 60/024,562 filed on Aug. 26, 1996.

BACKGROUND OF THE INVENTION

1. Field of Invention

This invention relates generally to protective structures and more particularly to an improved structure designed to serve as a bed frame and also as a protective shelter during a catastrophe such as an earthquake 2. Description of Related Art Calamities such as earthquakes, explosions, hurricanes, and tornadoes have taken many thousands of human lives and have caused severe injuries and much suffering. During such emergencies, an occupant of a dwelling is frequently exposed to falling objects when ceilings and upper floors deteriorate and fully or partially collapse. Objects such as flooring materials, floor joists, and other debris also present dangers when floors fail beneath the residents of a building. The possibility of injury or even death to such occupants is very real, particularly when the catastrophe occurs at night and there is no advance warning to permit evacuation of the dwelling. In regions of the world where earthquakes and tornadoes are most common, numerous deaths and injuries do occur while people are sleeping.

Statistics show that the probability of injuries from such a disaster is greatly reduced when the residents of a building are able to move to shelter under furniture, beams, tables, doorways, or other rigid elements of the building. However, in hospitals, homes for elderly and handicapped people, and nurseries for children, many people remain in bed, not only in the nighttime, but also during the day, without the ability to leave their beds to seek shelter. Additionally, the sudden shock of a strong earthquake often does not leave time for tenants, even adults in good health, to escape the menace of collapsing structures.

Canopy beds of various designs have been known for many years. Such canopies are conventionally used only for decorative or ornamental purposes. Other similar designs have as their object the support of insect screens, broken limbs, blankets, bedding, or even overhead entertainment centers. Such known canopies are generally flimsy in construction and are not intended to withstand substantial stresses from falling debris.

Sleeping compartments and shelters of various types have also been proposed in the prior art. Such designs have an unattractive appearance, would not adequately protect the occupants, or they require complicated systems, such as mechanical drives and hydraulic or spring loaded mechanisms, which would make them very expensive to produce. This additional expense would tend to exclude many people who live in disaster prone areas from the benefits which a protective bed frame could offer.

U.S. Pat. No. 2,607,047, to Posey, August, 1952, describes a boxlike plywood device for use as a bed and bomb or earthquake shelter for four persons. A bed of such construction has an unattractive appearance, would be difficult to produce and transport, and would not resist heavy loads and stresses.

U.S. Pat. No. 4,490,864, to Wicker, January, 1985, describes a bed which includes a drawer beneath the mattress. In an emergency, a person would slide open the drawer and drop into it, then slide the drawer closed, thus capturing himself in a secured area. This device would be difficult to operate during an earthquake.

U.S. Pat. No. 4,779,294, to Miller, October, 1988, is directed to a shedlike structure on four tubular legs which could be positioned above an existing bed.

This type of structure is unstable and can be easily overturned. It also provides its occupants with no protection from impact with objects below or to the sides, and has no means of securing its occupants from being ejected out of the sheltered area during strong horizontal movements. A design like this, with an arrangement of four unsupported and unbraced legs, would not resist heavy loads combined with strong lateral movements, which loads and movements could cause the structure to collapse.

U.S. Pat. No. 4,782,541, to Tuchman, November, 1988, describes a bed structure which incorporates mechanical shock absorbing devices into the framework. These shock absorbing devices require considerable expenditure in materials and labor to accomplish the purpose of resisting downward forces. This device also provides no protection from impact with objects which are below the sleeping area.

U.S. Pat. No. 4,965,895, to Shustov, October, 1990, describes a shedlike structure with four bedpost legs, which legs are supported by ball bearings resting on concave pedestals. U.S. Pat. No. 5 111,543 to Epshetsky May 1992, proposes a bed with a motorized pivoting or foldable cover. To produce either of these complicated systems would be prohibitive in cost. They would also require regular inspection and maintenance, and either device would occupy much more space than a traditional bed.

U.S. Pat. No. 5,241,717, to Ward, September, 1993, is directed to a structure which can be used as a cover for a work or sleeping area. It requires a multitude of individual parts, a seven degree angle is specified for the eight supporting legs, and the structure is covered by a steel mesh canopy. A cover of such construction has an unattractive appearance when used as a room furnishing, and when the steel mesh canopy is cleaned, dust particles fall down through the mesh cells onto the bedding. This type of structure is not designed to offer any impact protection from objects below or to the sides, and does not prevent the occupant from being thrown out during strong horizontal movements.

Objects and Advantages

Accordingly, several objects and advantages of my invention are to provide a protective bed frame which substantially enhances the probability of surviving an earthquake, explosion, tornado or other emergency, and to achieve this with a device which is aesthetically pleasing and has the appearance of a traditional piece of furniture, and which is also functional as a conventional bed. Still another object is to save lives and prevent injuries by providing a protective bed frame which is easy to produce, transport, and assemble, and therefore, more affordable and available to a larger segment of the population. Further objects are to provide a bed frame of the above mentioned type which will occupy the same space as a traditional bed and also be easy to clean and maintain.

The bed frame of the present invention is designed to provide protection using an arrangement of structural elements which are of sufficient strength and rigidity and properly placed so as to resist damaging forces and movements without the use of mechanisms such as shock absorbing devices, concave mounting pedestals, motorized pivoting or folding covers, or sliding drawers any of which would add to the cost and difficulty of production. Such mechanisms also require regular inspection and maintenance.

Another object is to provide a protective bed frame which can not only absorb the impact of falling debris but also help protect the occupant from injuries caused by impact from objects beneath the sleeping area. Such hazardous objects could include flooring materials and structural building elements such as floor joists. According to another feature of this invention, there are advantageously provided railings which extend at least partially about the periphery of the bed to help prevent ejection of the occupant during violent movements of the bed, thereby helping to maintain the occupant within the safe environment of the protective structure. Such railings also offer protection from side impact and may be provided with padding to cushion the occupants from injury.

Still another object is to immobilize the protective bed frame by securely anchoring it to the floor, and to provide these anchoring devices in such a way that they are hidden from view and do not detract from the attractive appearance of the bed frame. It is another object of this invention to provide a method by which the fasteners, hardware, and attaching devices which are used to produce and assemble the bed frame are also hidden from view, thereby adding to the pleasing appearance of the invention, which will then encourage more people to take advantage of the safety features it offers.

It is a further object of this invention to provide a protective bed frame which consists of only a few main subassemblies, to allow the protective bed frame to be easily and economically produced, transported, and assembled.

Another object is to provide a protective bed frame which can be readily modified in appearance, providing a variety of pleasing configurations by merely changing side and end panels, which can be easily and quickly attached. Such panels of various designs are particularly attractive to children, who could especially benefit from the protection offered by this invention. Another feature allows the attachment of protective panels to the bed frame structure. These panels are to be made of impact resistant materials which will shelter the occupant from such hazards as gunfire and explosions. When such panels are made of transparent materials, they will not detract from the aesthetic qualities of the protective bed frame, which will encourage more people to take advantage of the protection it offers. The protective bed frame can also be used as a shelter around an existing bed and bed frame arrangement.

Another object is to provide a protective bed frame which can be used as a baby crib. By the addition of side and end stiles, which are designed to protect an infant from falling or being thrown out of the safe environment of the protective structure, this bed frame will help protect an infant from injury during emergencies such as earthquakes, explosions, or tornadoes.

In accordance with one aspect of the present invention there is provided an improved bed frame to protect a person therein comprising a plurality of subassemblies secured together to resist loads and stresses from the bottom, sides and top thereof. The subassemblies include generally horizontal lower and upper sections secured at each end to two generally vertical end supporting sections. After assembly the bed frame is secured to the floor of a room in which it rests by means of securing means.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, wherein like reference numerals are used throughout the several views, and, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to describe an improved bed frame designed as a protective shelter.

Figure 1:
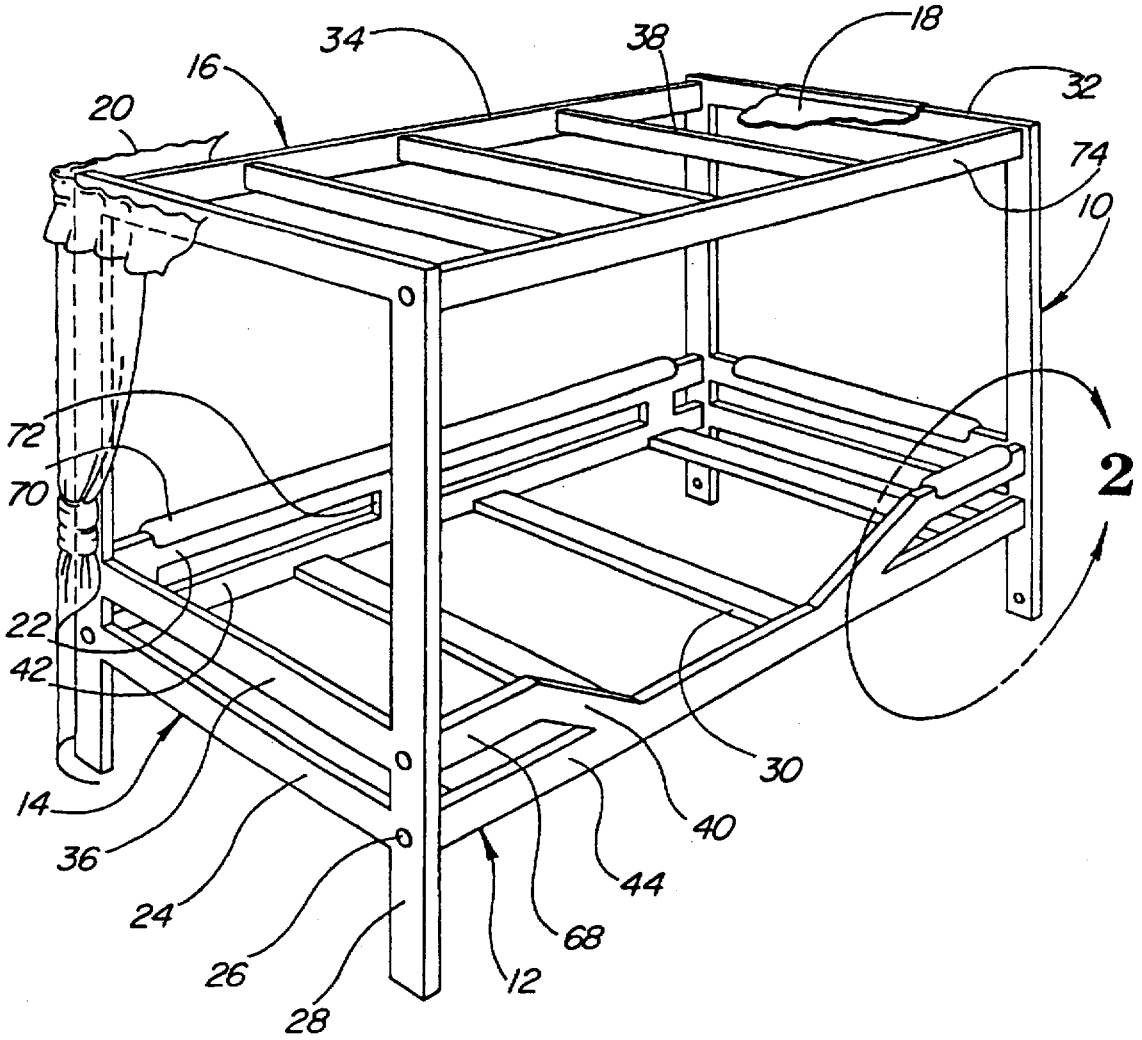
FIG. 1 is a perspective view of a protective bed frame.

The preferred embodiment of the protective bed frame of the present invention is illustrated in a perspective view in FIG. 1. The bed frame includes subassemblies which are preferably constructed of steel tubing or similar rigid material, which material can have a cross section of any shape.

These subassemblies include a mattress supporting subassembly 12, a vertical headboard subassembly 10, a vertical footboard subassembly 14, and an upper horizontal subassembly 16. Attachments within these subassemblies are by welding, bolting, adhesive, or comparable union.

A flat sleep support surface which may be, e.g., a spring box, along with a mattress, bedding, and pillows are to be positioned on top of mattress supporting subassembly 12, but are not illustrated as they have no relation to the invention and would complicate the drawing. A decorative fabric covering 20 is shown broken away to reveal more bed frame detail.

Upper horizontal subassembly 16 includes a left side horizontal member 34 and a right side horizontal member 74. A plurality of upper cross members 38 are between, perpendicular to, and attached to left member 34 and right member 74. This forms a rigid rectangular structure designed to resist impact from falling objects. A top plate 18, which is shown broken away, covers upper horizontal subassembly 16 and prevents debris from falling onto the sleeping area.

Mattress supporting subassembly 12 includes a left side frame member 42 and a right side frame member 44. A plurality of mattress supporting cross members 30 are between, perpendicular to, and attached to left side member 42 and right side member 44. A plurality of vertical stiles 72 are attached to the top of left side member 42. Attached to the top of stiles 72 is a guard rail 22 which is thus located above and parallel to left side member 42. A diagonal brace 40 is attached to the top of right side member 44 near each end of member 44. Attached to the top of each diagonal brace 40 is a guard rail segment 68, which is thus located above and parallel to right side member 44. This forms a rigid rectangular boxlike structure for the protection of the occupant and for retaining a sleep support surface.

Vertical headboard subassembly 10 and vertical footboard subassembly 14 are similar to each other in construction. Each includes a horizontal member 32 to protect the occupant of the protective bed frame. Attached to and perpendicular to each end of member 32 is a vertical post or column 28, which posts 28 are thus located parallel to each other. A guard rail member 36 and a cross member 24 are between, perpendicular to, and attached to each pair of posts 28. This forms a pair of rigid structures which are each used to support one end of the protective bed frame. A length of guard rail pad 70 may be attached to the top of each member 36, segment 68, and rail 22.

Figure 2:
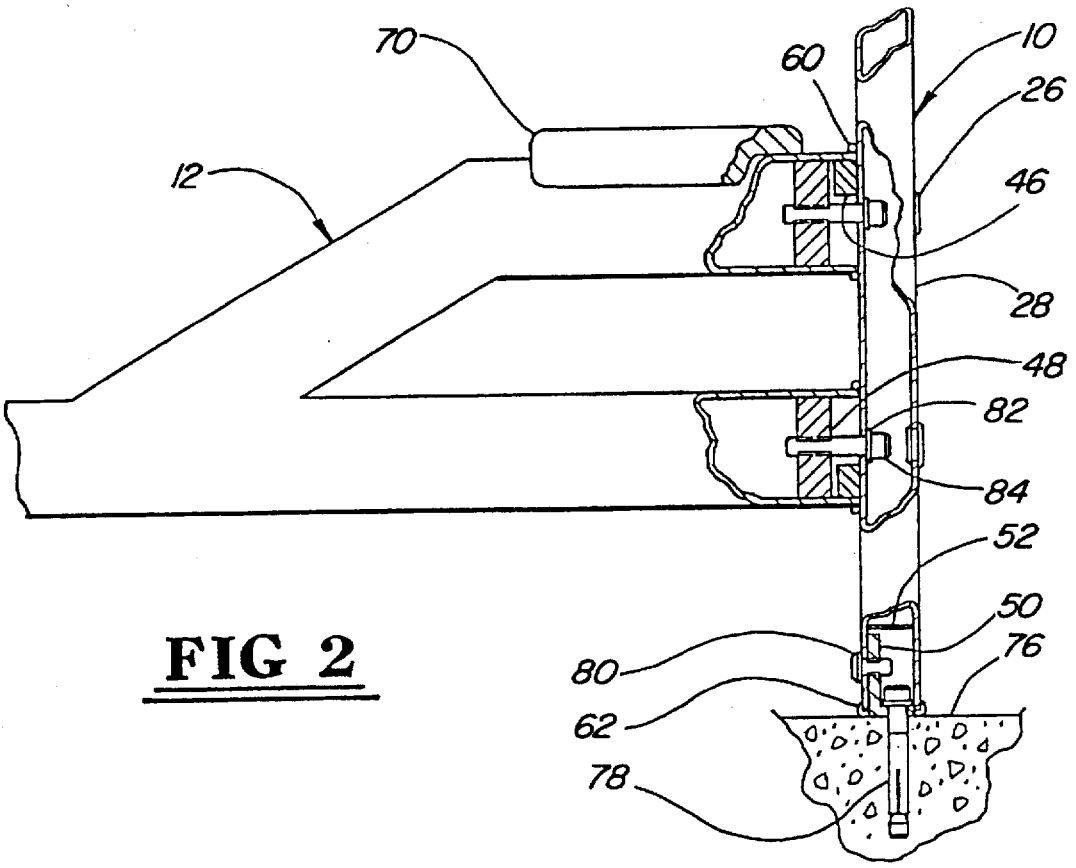
FIG. 2 is a view in detail of the portion shown in the lower right corner of FIG. 1.

FIG. 2 shows a nut plate 48 which is attached to the inside of each end of left side member 42 right side member 44, guard rail segments 68, guard rail 22, left horizontal member 34, and right horizontal member 74.

A plurality of shear blocks 46 are attached to posts 28. Blocks 46 are placed to resist shearing forces caused by impact from falling debris or impact from objects beneath the protective bed frame.

For final assembly, at the location of each nut plate 48, securing means, such as a cap screw 84 is passed through a lock washer 82 and through clearance holes in corner post 28 to engage threads in nut plate 48. A trim ring 60 is placed around the exterior of each of these junctions to conceal the joint and maintain the pleasing appearance of the bed frame. After screws 84 are tightened, the bed frame provides a rigid structure to protect its occupant. A decorative closure or plug 26 snaps into each exposed clearance hole in posts 28, providing an attractive method of concealing the fastening devices from view. If tubing is used to construct posts 28, as illustrated, a baffle or partition plate 52 is attached to the interior of posts 28, forming an interior baffle wall.

Anchoring means, such as a mounting or anchor block 50 is provided at each corner of the protective bed frame for the purpose of securely anchoring the entire bed frame assembly to the floor. FIG. 2 shows the bed frame mounted to an existing floor 76 using an anchor 78 installed through each block 50.

As shown in FIG. 2, a decorative welting 62 is placed around the bottom of vertical post 28. Each post 28 is then lowered onto its corresponding block 50 and fastened to block 50 using a button head screw 80 or a similar decorative fastener. This provides a positive method of immobilizing the bed frame while having the anchoring devices concealed from view, so that the protective bed frame appears to be a conventional piece of furniture.

Figure 3:
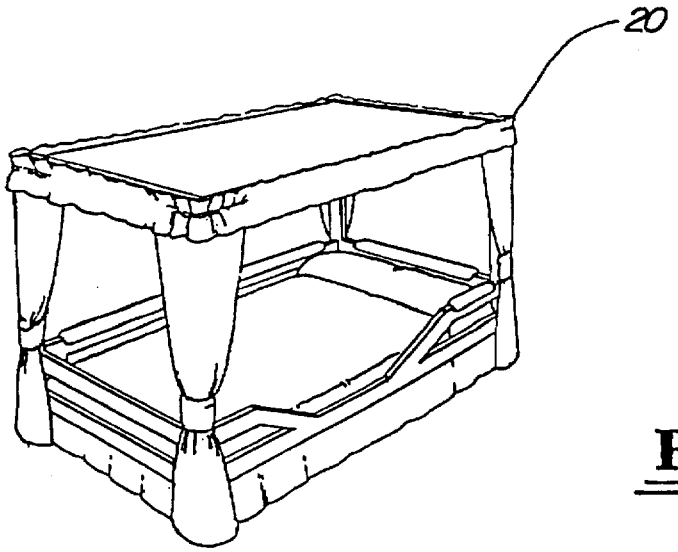
FIG. 3 is a perspective view of a protective bed frame in conjunction with a traditional decorative canopy arrangement.

FIG. 3 shows a protective bed frame used with a traditional decorative fabric canopy arrangement 20.

Figure 4:
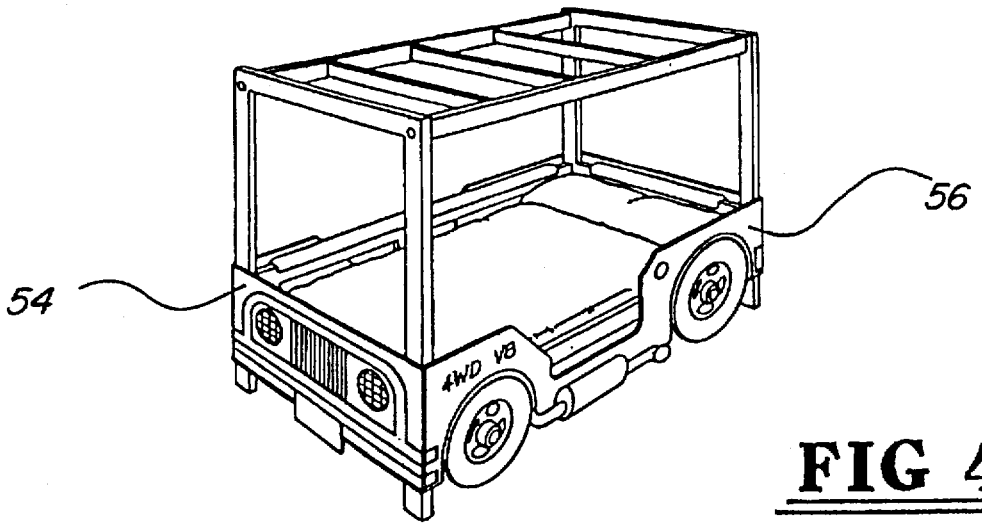
FIG. 4 is a perspective view of an embodiment of a protective bed frame using decorative side and end panels.

FIG. 4 illustrates an embodiment of a protective bed frame using a set of decorative end panels 54 and a set of decorative side panels 56. Panel 54 may be of various configurations and is usually used in sets of two, with one panel being attached to the headboard end and one panel attached to the footboard end of the protective bed frame. Panel 56 may be of various configurations and is usually used in mirror image sets of two, and is attached to the sides of the bed frame. Attachment is accomplished using standard purchased threaded fasteners. Thus a protective bed frame can be easily customized in appearance and particularly used as a bed for children.

Figure 5:
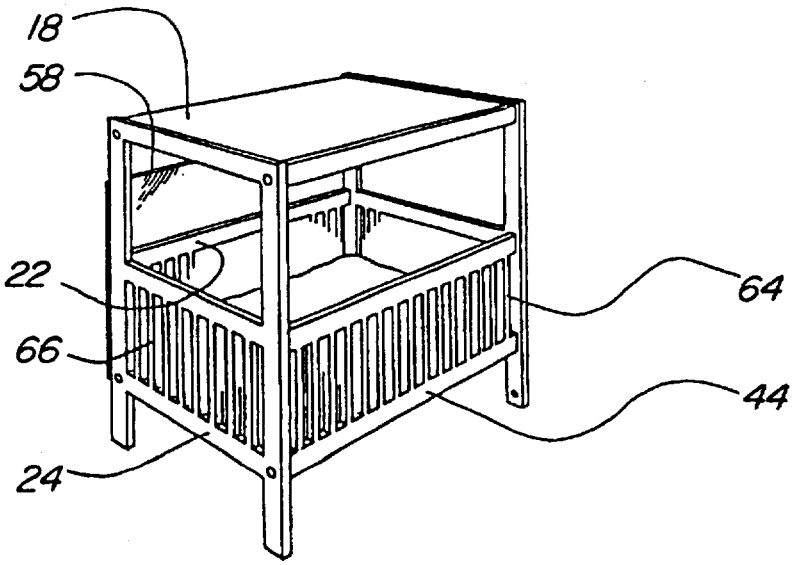
FIG. 5 is a perspective view of an embodiment of a protective bed frame designed for use as a baby crib and having a transparent impact resistant side panel attached.

FIG. 5 illustrates an embodiment of a protective bed frame designed for use as a baby crib. A plurality of vertical crib stiles 64 are attached to the top of left side member 42, instead of using stiles 72 which are shown in FIG. 1. Attached to the top of stiles 64 is guard rail 22. This construction is duplicated on top of right side member 44, instead of using braces 40 and segments 68 which are also shown in FIG. 1. A plurality of vertical end stiles 66 are attached to the top of each member 24 in the headboard subassembly 10 and in the footboard subassembly 14. Attached to the top of stiles 66 is each guard rail member 36. Vertical crib stiles 64 and end stiles 66 are designed to prevent an infant from falling or being thrown out of the protective bed frame.

FIG. 5 also illustrates the attachment of a shield or impact resistant panel 58, which panel 58 may be constructed of transparent material for aesthetic purposes, and is attached to vertical posts 28 using standard purchased threaded fasteners at each corner of panel 58. Panel 58 thus provides an easily attached device to shelter the occupants of a protective bed frame from such hazards as gunfire and explosions, and can be used in a similar manner with any embodiment of a protective bed frame.

Another embodiment of a protective bed frame, that of a shelter to fit around an existing bed and bed frame arrangement, has the same basic form shown by the illustration in FIG. 1. The construction and operation is the same as that given above in the description of FIG. 1, except for the use of subassembly 12. This subassembly 12 would then be used as a barrier offering protection from impact with objects below and to the sides, and to retain the occupant, rather than also being used as a support for the spring box, mattress, bedding, etc.

Summary, Ramifications, and Scope

Accordingly, the reader will see that the protective bed frame possesses a totally new quality: With object to prevent injuries and deaths in the event of a collapsing building above and/or a failing floor below, to protect its occupant by providing a sturdy cagelike structure which will give shelter, while at the same time functioning as a conventional bed and having the appearance of a traditional piece of furniture. The bed frame also forms a secure structure which helps to retain the occupant and prevent him from being thrown out of the protected area, it offers protection from side impact, and it also provides a sturdy anchoring system which is concealed inside the framework.

In addition, the protective bed frame occupies the same amount of floor space as a conventional bed, is easy to clean, and has no mechanisms requiring inspection or maintenance. Its simplicity of design allows it to be easily and economically produced, transported, and assembled, making the bed frame affordable and therefore available to a large portion of the populace living in seismic or disaster-prone areas. The protective bed frame can be configured to function as a traditional bed, as a baby crib, as a shelter to surround an existing bed, and as a youth bed with decorative panels, thus appealing to a large population group and encouraging its use as a safety device.

While my above description contains many specificities, these should not be construed as limitations on the scope of the invention, but rather as exemplifications of some of the presently preferred embodiments thereof. Many other variations are possible. For example, the protective bed frame could be configured for use as bunk beds, as an adjustable hospital bed, or as a protective water bed frame.

Accordingly, the scope of the invention should be determined by the appended claims and their legal equivalents, rather than by the examples given.

What is claimed is:

1. A protective bed frame for protecting persons therein during a calamity, comprising:

a plurality of subassemblies secured together by internal securing means to form a protective bed frame which has the appearance of a conventional piece of furniture;

said subassemblies including a generally horizontal upper section having two ends and a cover therein; a generally horizontal lower section having two ends and side rails to hold an occupant and for retaining a sleep support surface therein; and two generally vertical end supporting sections secured to the two ends of the generally horizontal upper and lower sections; and anchoring means cooperating with said two generally vertical end supporting sections to anchor said protective bed frame to a supporting surface; said anchoring means comprising a mounting block mounted internally of each of said two generally vertical end supporting section, and an anchor installed through each of said mounting blocks into said supporting surface.

2. The protective bed frame of claim 1, further including a plurality of stiles secured to said side rails and said two ends of said generally horizontal lower section.

3. The protective bed frame of claim 1, further including a plurality of decorative end panels and side panels secured thereto.

4. The protective bed frame of claim 1, further including a shield attached to said two general vertical end supporting sections.

5. The protective bed frame of claim 4 wherein said shield is transparent.

6. A protective bed frame for protecting persons therein during a calamity, comprising, in combination:

a plurality of rigid subassemblies secured together by internal securing means to form the protective bed frame which has the appearance of a conventional piece of furniture;

said rigid subassemblies including a generally horizontal rigid upper section having two ends and a solid cover therein; a generally horizontal rigid, rectangular, box-like lower section having two ends and side rails to hold and retain a at least one occupant and a sleep support surface therein; and two generally vertical rigid end supporting sections secured to the two ends of the generally horizontal rigid upper section and generally horizontal, rigid lower section;

said rigid subassemblies being formed of rigid structural elements having to resist stresses and loads caused by bottom, top and side impacts from foreign objects by means of stationary side elements secured thereto; and anchoring means provided in each of the two generally vertical, rigid end supporting sections to anchor said protective bed frame to a supporting surface.

7. The protective bed frame of claim 6, further including a plurality of stiles secured to said side rails and said two ends of said generally horizontal, rigid, rectangular, box-like, lower section; and a shield attached between said two generally vertical, rigid end supporting sections.

8. The protective bed frame of claim 6, further including a plurality of decorative end and side panels secured to the protective bed frame, and a shield attached between said two generally vertical, rigid end supporting sections.

9. A protective bed frame for protecting persons therein during a calamity, comprising in combination:

a plurality of rigid, high strength subassemblies secured together by internal securing means to form the protective bed frame which has the appearance of a conventional piece of furniture;

said rigid, high strength subassemblies including a generally horizontal upper section having two ends and a solid, supported cover therein; a generally horizontal lower section having two ends and side rails to form a rigid, rectangular, box-like structure to hold an occupant, and for retaining a sleep support surface therein; and two generally vertical end supporting sections secured to the two ends of the generally horizontal upper and lower sections; and anchoring means having openings formed therein held in said two generally vertical end supporting sections, and anchors passing through said openings formed in said anchoring means to secure said protective bed frame to a supporting surface.

* * * * *